US007226391B2

(12) United States Patent
Hsu

(10) Patent No.: US 7,226,391 B2
(45) Date of Patent: Jun. 5, 2007

(54) ELLIPTICAL EXERCISE DEVICE

(75) Inventor: Eric Hsu, Taipei (TW)

(73) Assignee: Limax International Inc., Taipei (TW)

( * ) Notice: Subject to any disclaimer, the term of this patent is extended or adjusted under 35 U.S.C. 154(b) by 74 days.

(21) Appl. No.: 11/228,837

(22) Filed: Sep. 16, 2005

(65) Prior Publication Data

US 2007/0037669 A1 Feb. 15, 2007

(30) Foreign Application Priority Data

Aug. 9, 2005 (TW) ..... 94213576 U

(51) Int. Cl.
*A63B 22/00* (2006.01)

(52) U.S. Cl. ..... 482/52; 482/57

(58) Field of Classification Search ..... 482/51, 482/52–53, 57, 70, 79
See application file for complete search history.

(56) References Cited

U.S. PATENT DOCUMENTS 5,383,829 A 1/1995 Miller
5,707,321 A * 1/1998 Maresh ..... 482/57
6,786,851 B1 * 9/2004 Maresh ..... 482/52
6,905,441 B2 * 6/2005 Anderson et al. ..... 482/52
6,949,054 B1 * 9/2005 Stearns et al. ..... 482/52
7,153,238 B2 * 12/2006 Anderson et al. ..... 482/52

* cited by examiner

*Primary Examiner*—Stephen R. Crow
(74) *Attorney, Agent, or Firm*—Knobbe Martens Olson & Bear LLP

(57) ABSTRACT

An elliptical exercise device includes a main frame having a rotary shaft defining an axis, left and right link rods having rear ends connected to the rotary shaft for rotation about the axis, left and right arms connected respectively to front ends of the link rods for reciprocal movement, and left and right foot plates connected pivotally and respectively to the link rods and movable along elliptical paths when the rear ends of the link rods rotate. A guide mechanism is connected to the foot plates and the main frame to restrict movement of the foot plates. Each foot plate is substantially horizontal when moving upward or downward from the lowest or highest point of the corresponding elliptical path.

8 Claims, 7 Drawing Sheets

ELLIPTICAL EXERCISE DEVICE

CROSS-REFERENCE TO RELATED APPLICATION

This application claims priority of Taiwanese Application No. 094213576, filed on Aug. 9, 2005.

BACKGROUND OF THE INVENTION

1. Field of the Invention

The invention relates to exercise equipment, more particularly to an elliptical exercise device.

2. Description of the Related Art

FIG. 1 shows a conventional stationary exercise device disclosed in U.S. Pat. No. 5,383,829. The conventional stationary exercise device includes a frame 11, two foot links 12, two coupling members 13, and two guide members, in the form of tracks 14. The frame 11 has a pivot axis defined by a shaft 16 which is supported by the frame 11, and a flywheel 15 supported by the shaft 16 for rotation about the pivot axis. Each coupling member 13 has one end connected pivotally to the shaft 16, and an opposite end connected pivotally to a first end of the corresponding foot link 12. A second end of each foot link 12 is provided with a roller unit 17 operable to slide along a respective one of the tracks 14. When the flywheel 15 is rotated, the coupling members 13 bring the first end of each foot link 12 to travel in a circular path about the pivot axis, while the tracks 14 direct the second end of each foot link 12 in a reciprocal path as the first ends of the foot links 12 travel about the pivot axis.

With reference to FIG. 2, in combination with FIG. 1, when the user places his/her foot on a foot retaining pad 121 of the respective foot link 12 and starts to exercise with his/her foot moving forwardly and consecutively at locations IV, III, II and I, the heel portion of the user's foot rises at a faster rate than the toe portion.

With reference to FIG. 3, when the user's foot moves rearwardly and consecutively at locations I, VI, V and IV, the heel portion of the user's foot lowers at a faster rate than the toe portion.

SUMMARY OF THE INVENTION

Therefore, the object of the present invention is to provide an elliptical exercise device that can permit foot plates to remain substantially horizontal during exercise.

According to this invention, an elliptical exercise device comprises a main frame adapted to be mounted on the ground and having a rotary shaft defining an axis, left and right link rods, left and right arms, left and right foot plates, and a guide mechanism. Each of the left and right link rods has a front end, and a rear end connected to the rotary shaft for rotation about the axis. The left and right arms are connected respectively to the front ends of the left and right link rods for moving reciprocally when the rear ends of the left and right link rods rotate about the axis. The left and right foot plates are connected respectively to the left and right link rods, and are movable upward and downward along respective elliptical paths when the rear ends of the left and right link rods rotate. The guide mechanism is mounted on the main frame, and is connected to the left and right foot plates to guide movement of the left and right foot plates so that each of the left and right foot plates is substantially horizontal when moving upward or downward from the lowest or highest point of a corresponding one of the elliptical paths.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
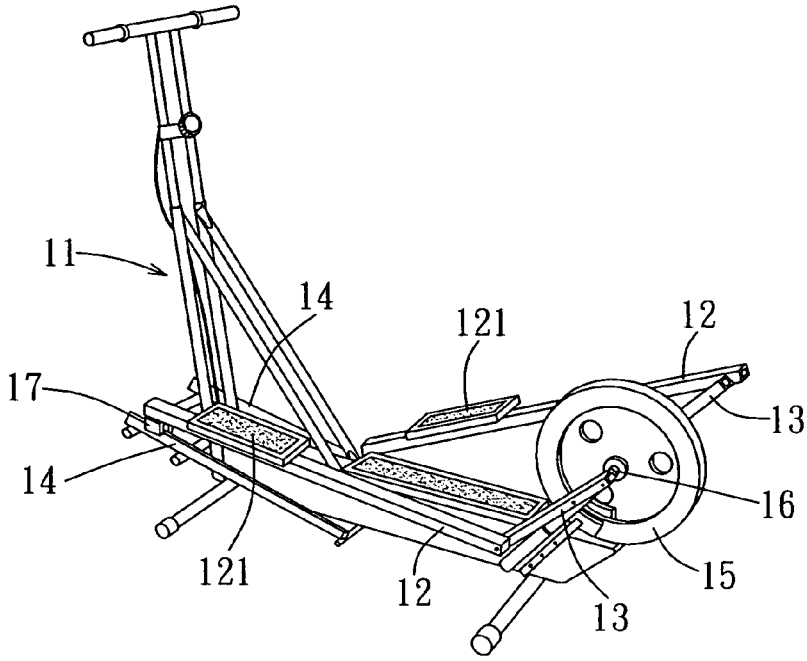
FIG. 1 PRIOR ART
FIG. 1 is a perspective view of a conventional stationary exercise device disclosed in U.S. Pat. No. 5,383,829.
Figure 2:
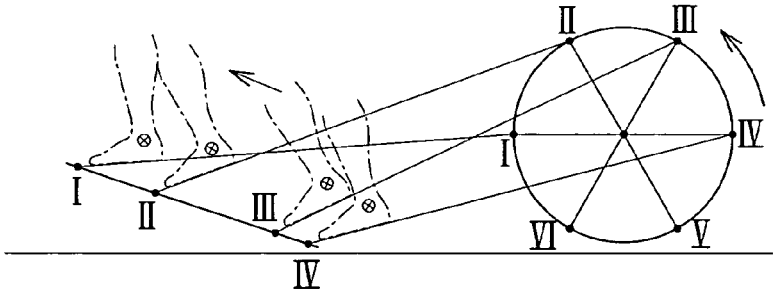
FIG. 2 PRIOR ART
FIG. 2 is a schematic depiction of forward movement of a user's foot during use of the exercise device of FIG. 1.
Figure 3:
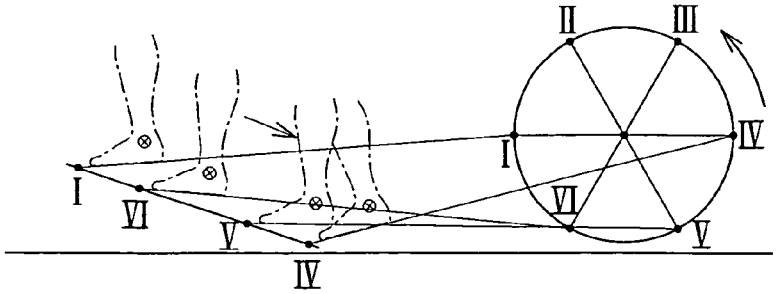
FIG. 3 PRIOR ART
FIG. 3 is a schematic depiction of rearward movement of the user's foot during use of the exercise device of FIG. 1.

Referring to FIGS. 4 to 10, the preferred embodiment of an elliptical exercise device according to the present invention is shown to comprise a main frame 2, left and right link rods 3', 3, left and right arms 4', 4, left and right foot plates 5', 5, and a guide mechanism which includes rail mechanisms 6', 6 and slide mechanisms 63', 63.

The main frame 2 includes an upright post 20, front and rear supports 21 adapted to be mounted on the ground, a housing 7 connected between the front and rear supports 21, and a rotary shaft 22 supported on the housing 7 and defining an axis. A flywheel 23 is mounted within the housing 7, and is supported on the rotary shaft 22 for rotation about the axis.

The left and right link rods 3', 3 are disposed respectively on left and right sides of the main frame 2. Each of the left and right link rods 3', 3 has a front end 32', 32, and a rear end 31', 31 connected pivotally to the flywheel 23. The rear end 31', 31 is spaced apart from the rotary shaft 22 by a predetermined distance. When the flywheel 23 is rotated, the rear ends 31', 31 of the left and right link rods 3', 3 move about the axis along a circular path.

Figure 10:
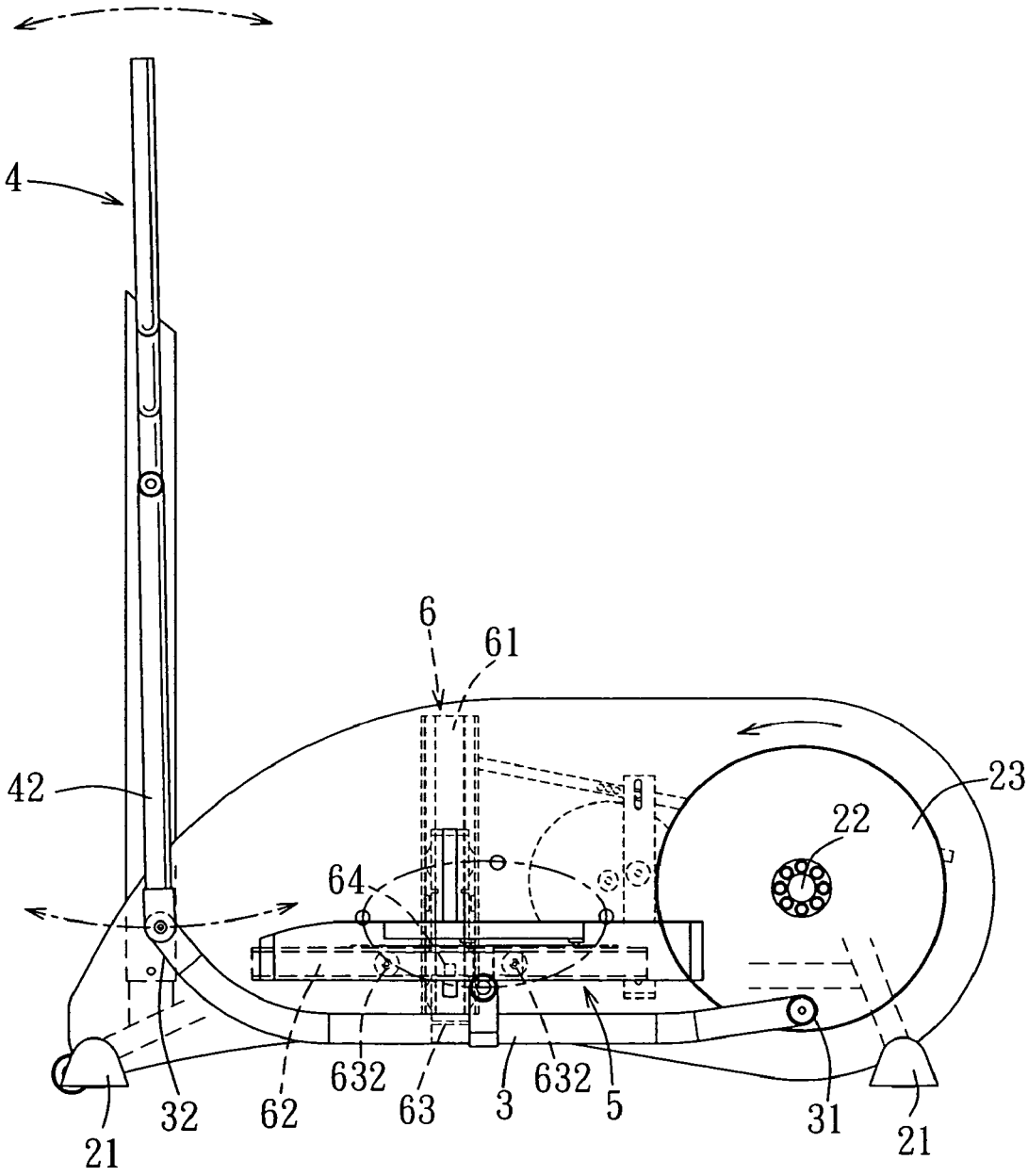
FIG. 10 is a schematic side view, illustrating an elliptical path during use of the preferred embodiment.

The left and right arms 4', 4 are connected pivotally and respectively to left and right sides of the upright post 20 of the main frame 2, and have bottom ends 42', 42 connected pivotally and respectively to the front ends 32', 32 of the left and right link rods 3', 3 for directing the same to move reciprocally along pre-selected paths when the rear ends 31', 31 of the left and right link rods 3', 3 rotate about the axis along their respective circular paths. As indicated in FIG. 10, the pre-selected path of each of the bottom ends 42', 42 (only the bottom end 42 is visible) is an arcuate path. Each of the left and right arms 4', 4 has a handle 41', 41 extending upwardly from a pivot part 43', 43 of a respective one of the left and right arms 4', 4. When the rear ends 31', 31 of the left and right link rods 3', 3 are rotated by the flywheel 23, the front ends 32', 32 of the left and right link rods 3', 3 move the respective left and right arms 4', 4 reciprocally along their respective arcuate paths. The left and right arms 4', 4, in turn, move the handles 41', 41 of the left and right arms 4',4, thereby exercising the muscles of the user's hands, arms, back, etc.

The left and right foot plates 5', 5 are connected pivotally and respectively to intermediate sections of the left and right link rods 3', 3. When the rear ends 31', 31 of the left and right link rods 3', 3 move along the respective circular paths, the rail mechanisms 6',6 and the slide mechanisms 63', 63 direct the left and right foot plates 5', 5 to move along respective loop paths, i.e., elliptical paths, one of which is indicated in FIG. 10.

The rail mechanisms 6', 6 are connected respectively to the left and right foot plates 5', 5 to restrict and guide movement of the same. Each foot plate 5', 5 is substantially horizontal when moving upward from the lowest point of the elliptical path or when moving downward from the highest point of the elliptical path. The movement of the foot plates 5', 5 will be detailed hereinafter.

Figure 4:
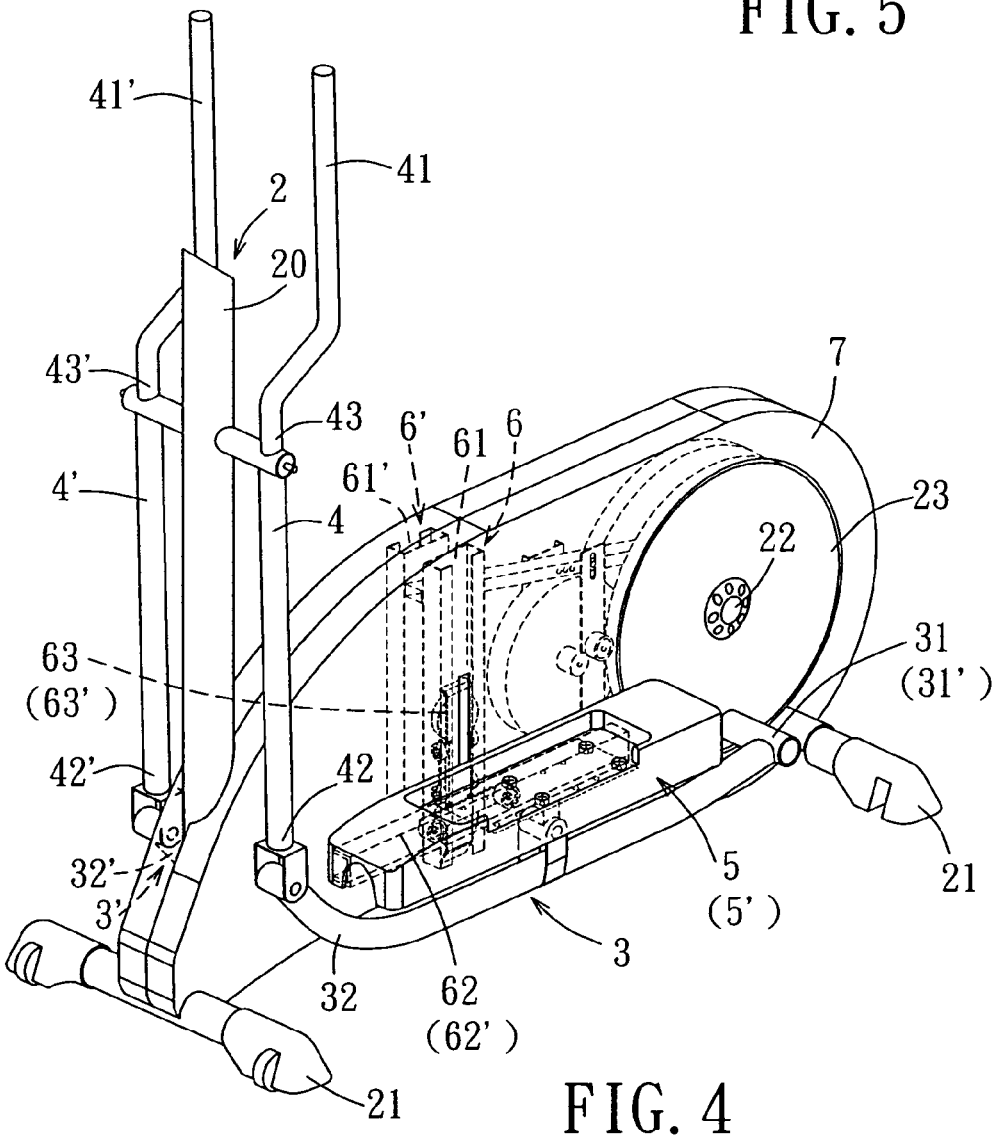
FIG. 4 is a perspective view of the preferred embodiment of an elliptical exercise device according to the present invention.

As shown in FIG. 4, each of the rail mechanisms 6', 6 includes a vertical rail 61', 61 mounted fixedly within the housing 7 of the main frame 2, and a horizontal rail 62', 62 disposed fixedly in a respective one of the left and right foot plates 5', 5 and intersecting the vertical rail 61', 61 at a right angle.

Figure 5:
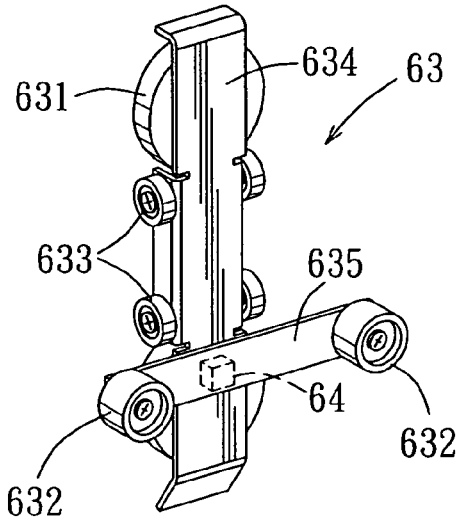
FIG. 5 is a perspective view of a slide mechanism of the preferred embodiment.

The slide mechanisms 63', 63 are connected respectively to the left and right foot plates 5', 5. Since the structures of the slide mechanisms 63', 63 are the same, only the slide mechanism 63 connected to the right foot plate 5 will be described hereinafter. As shown in FIG. 5, in combination with FIG. 4, the slide mechanism 63 includes a vertical slide plate 634 slidable along the vertical rail 61, a horizontal slide plate 635 fixed transversely to the vertical slide plate 634 through a fixing unit 64 and slidable along the horizontal rail 62, a plurality of first rollers 631 and 633 attached to the vertical slide plate 634, and a plurality of second rollers 632 attached to the horizontal slide plate 635. The first rollers 631, 633 are rollable in the vertical rail 61, and the second rollers 632 are rollable in the horizontal rail 62. The vertical and horizontal rails 61, 62 and the slide mechanism 63 direct the right foot plate 5 to move upward and downward and forward and rearward along the elliptical path when the rear end 31 of the right link rod 3 is rotated along with the flywheel 23.

Figure 6:
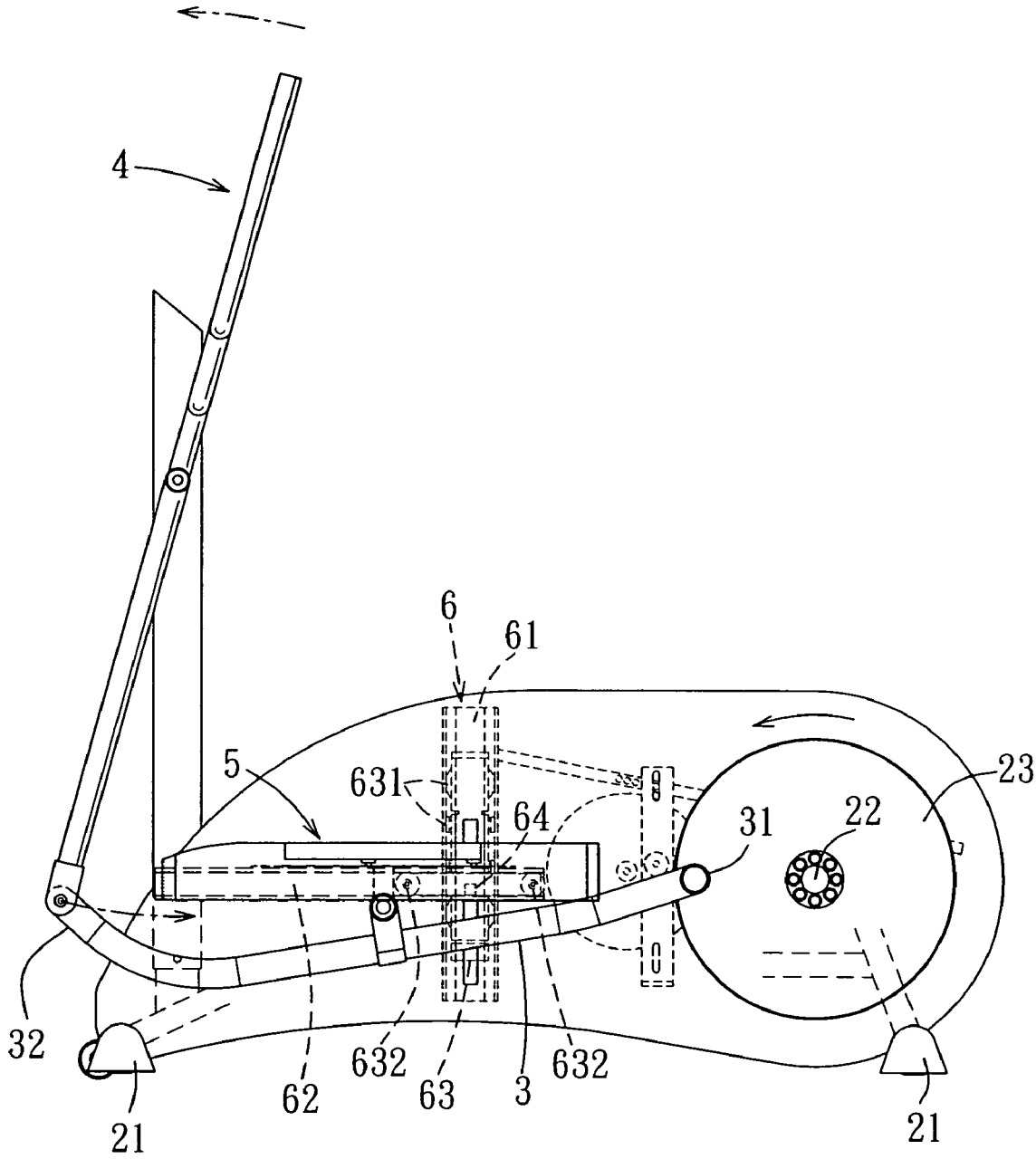
FIGS. 6 to 9 illustrate different states of use of the preferred embodiment.
Figure 7:
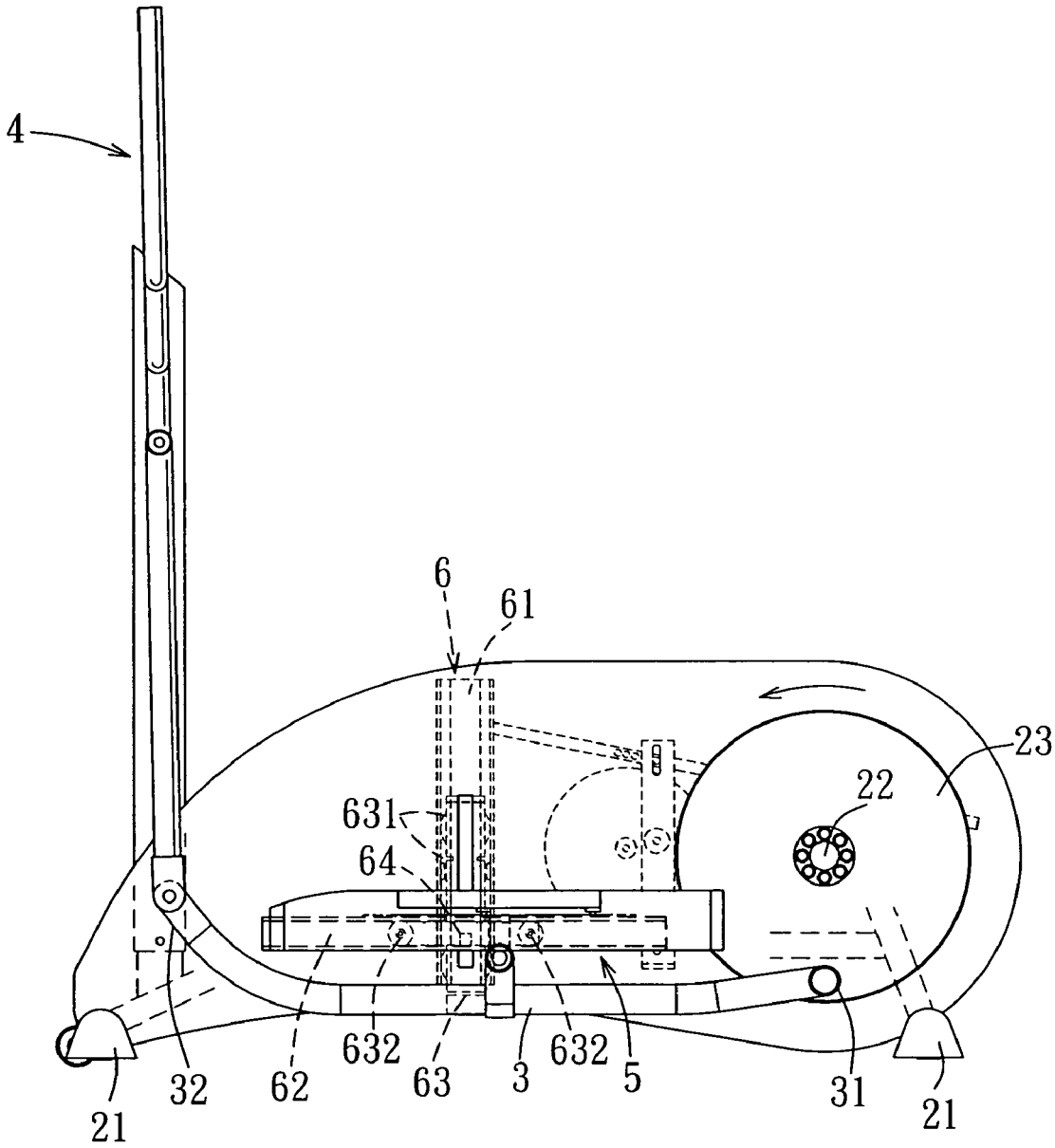

Referring to FIGS. 6 to 9, since the left and right sides of the elliptical exercise device of the present invention are symmetrical, only the right side of the device will be described hereinafter. During exercise, the user moves the foot plate 5 so that the flywheel 23 is rotated about the axis and the rear end 31 of the link rod 3 travels along the circular path. Due to the guidance provided by the vertical and horizontal rails 61, 62, the foot plate 5 is directed to move upwardly, downwardly, forwardly, and rearwardly along the elliptical path. In FIGS. 6 and 7, when the foot plate 5 moves rearwardly from the frontmost position and downwardly from an upper position, the front end 32 of the link rod 3 moves downward from a higher point of the arcuate path. As a result of the pivotal connection of the foot plate 5 to the link rod 3, as well as the disposition of the vertical and horizontal rails 61, 62 and cooperation of the same with the slide mechanism 63 as described above, the heel portion and the toe portion of the user's foot are maintained substantially horizontal.

Figure 8:
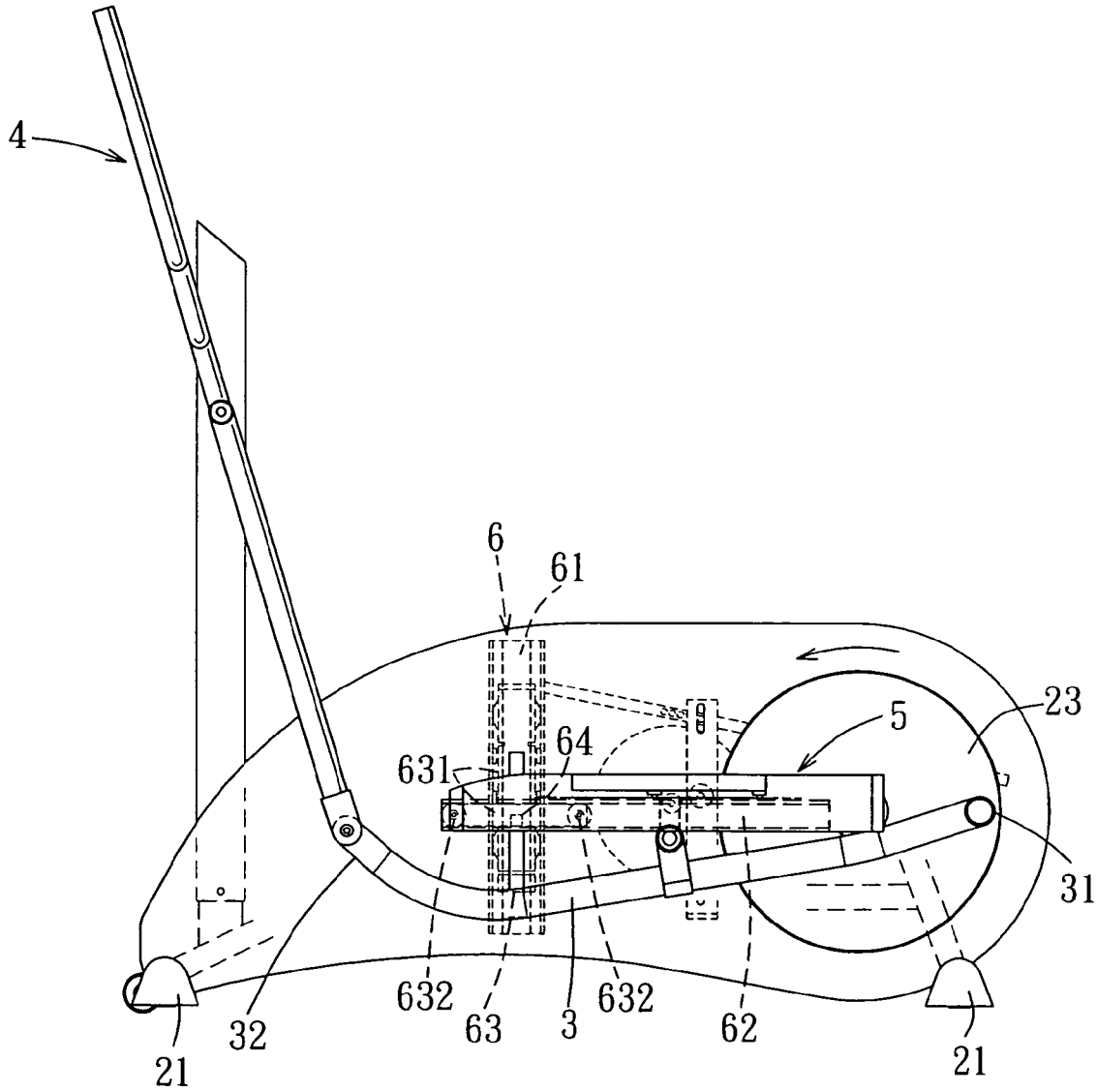
Figure 9:
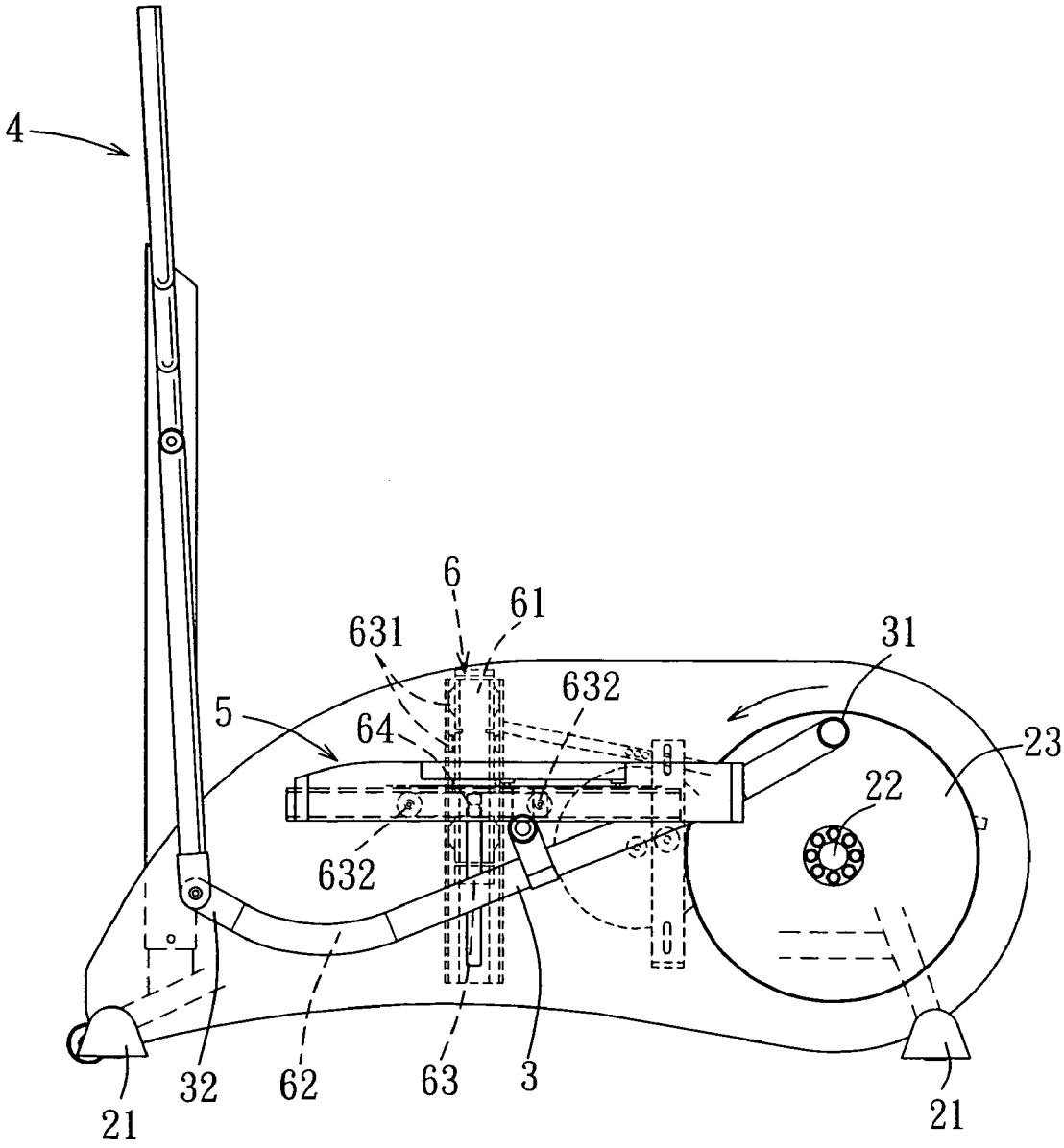

In FIGS. 8 and 9, when the foot plate 5 moves forwardly from the rearmost position and upwardly from a lower position, the front end 32 of the link rod 3 moves downwardly from a higher point of the arcuate path. For the same reasons discussed above, the heel portion and the toe portion of the user's foot are maintained substantially horizontal.

Conclusively, according to the present invention, the foot plate 5 is constantly horizontal during its entire movement along the elliptical path. Hence, the heel portion and the toe portion of the user's foot can be maintained in the horizontal position at all times.

Note that the present invention should not be limited to the construction as described above. To increase training effectiveness, other components, such as a brake, a resistance unit, etc., may be added to the flywheel 23. Furthermore, the flywheel 23 may be replaced by a motor to activate the left and right link rods 3', 3.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An elliptical exercise device comprising:

a main frame adapted to be mounted on the ground and having a rotary shaft defining an axis;

left and right link rods each having a front end, and a rear end connected to said rotary shaft for rotation about said axis;

left and right arms connected respectively to said front ends of said left and right link rods for moving reciprocally when said rear ends of said left and right link rods rotate about said axis;

left and right foot plates connected respectively to said left and right link rods and movable upward and downward along respective elliptical paths when said rear ends of said left and right link rods rotate; and a guide mechanism mounted on said main frame and connected to said left and right foot plates to guide movement of said left and right foot plates so that each of said left and right foot plates is substantially horizontal when moving upward or downward from the lowest or highest point of a corresponding one of said elliptical paths.

2. The elliptical exercise device of claim 1, further comprising a flywheel supported on said rotary shaft for rotation about said pivot axis, said rear end of each of said left and right link rods being connected to said flywheel.

3. The elliptical exercise device of claim 1, wherein said guide mechanism includes a rail mechanism and a slide mechanism slidable on said rail mechanism.

4. The elliptical exercise device of claim 3, wherein said rail mechanism includes a vertical rail, and a horizontal rail intersecting said vertical rail at a right angle, said slide mechanism being slidable along said vertical and horizontal rails.

5. The elliptical exercise device of claim 4, wherein said vertical rail is provided in said main frame, said horizontal rail being disposed in one of said left and right foot plates.

6. The elliptical exercise device of claim 5, wherein said slide mechanism includes a vertical slide plate slidable in said vertical rail, and a horizontal slide plate fixed to and intersecting said vertical slide plate and slidable along said horizontal rail.

7. The elliptical exercise device of claim 6, wherein said slide mechanism further includes a plurality of rollers attached to said vertical and horizontal slide plates.

8. The elliptical exercise device of claim 1, wherein said left and right arms are connected pivotally to said main frame, each of said left and right arms having a handle.

* * * * *